US007383830B2

(12) United States Patent
Matsui et al.

(10) Patent No.: US 7,383,830 B2
(45) Date of Patent: Jun. 10, 2008

(54) IGNITION APPARATUS FOR INTERNAL COMBUSTION ENGINE

(75) Inventors: Tomohito Matsui, Hyogo (JP); Takeshi Shimizu, Tokyo (JP)

(73) Assignee: Mitsubishi Electric Corporation, Toky (JP)

( * ) Notice: Subject to any disclaimer, the term of this patent is extended or adjusted under 35 U.S.C. 154(b) by 0 days.

(21) Appl. No.: 11/589,816

(22) Filed: Oct. 31, 2006

(65) Prior Publication Data

US 2008/0006254 A1 Jan. 10, 2008

(30) Foreign Application Priority Data

Jul. 4, 2006 (JP) ..... 2006-184265

(51) Int. Cl.
*H01F 38/12* (2006.01)

(52) U.S. Cl. ..... 123/634; 336/90; 123/143 B

(58) Field of Classification Search ..... 123/260, 123/632, 633, 634, 635, 143 B; 336/96, 336/107

See application file for complete search history.

(56) References Cited

U.S. PATENT DOCUMENTS 5,497,756 A * 3/1996 Matthiesen et al. ..... 123/634
7,036,495 B1 * 5/2006 Shimizu ..... 123/633
7,213,558 B2 * 5/2007 Iwata et al. ..... 123/184.55
2007/0023019 A1 * 2/2007 Hamada et al. ..... 123/634
2007/0181109 A1 * 8/2007 Matsui et al. ..... 123/634

FOREIGN PATENT DOCUMENTS

JP 10-339253 A 12/1998

* cited by examiner

*Primary Examiner*—Willis R. Wolfe
*Assistant Examiner*—Johnny H. Hoang
(74) *Attorney, Agent, or Firm*—Sughrue Mion, PLLC

(57) ABSTRACT

An ignition apparatus for an internal combustion engine can eliminate connecting leads for electrically connecting between an igniter and a connector can be eliminated or shortened. In the ignition apparatus, individual terminals (14*a*, 14*b*, 15*a*, 15*b*) in the form of connector side terminals of an igniter (9) are directly connected to individual terminals (10*a*, 10*b*, 11*a*, 11*b*) in the form of input terminals of a connector (8), and individual terminals (18*a*, 18*b*, 19*a*) in the form of transformer side terminals of the igniter (9) are directly connected to individual terminals (16*a*, 16*b*, 17*a*), respectively, which are winding terminals of a transformer (1).

5 Claims, 6 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine which applies a high voltage for generation of park discharge to a spark plug for each engine cylinder.

2. Description of the Related Art

In the past, there has been known an ignition apparatus for an internal combustion engine which includes a transformer having a primary winding and a secondary winding, an igniter for controlling an excitation current supplied to the primary winding, a connector that sends to the igniter a drive signal for driving the igniter, and a case that receives the transformer and the igniter (see, for example, a first patent document: U.S. Pat. No. 6,575,151).

In this case, the igniter has transformer side terminals that are electrically connected to winding terminals arranged at respective ends of the primary winding and the secondary winding, and a connector side terminal that is electrically connected to an input terminal of the connector.

In the case of such an ignition apparatus for an internal combustion engine, the connector side terminal of the igniter is led out in a direction different from that of the input terminal of the connector. As a result, there is the following problem. That is, connecting leads are required for electrically connecting the connector side terminals and the input terminals to each other, so the apparatus as a whole is enlarged in size for securing an installation space for the connecting leads, and the cost of production is accordingly increased.

SUMMARY OF THE INVENTION

Accordingly, the present invention is intended to obviate the problems as referred to above, and has for its object to obtain an ignition apparatus for an internal combustion engine which is capable of removing connecting leads or reducing the lengths thereof, thus making it possible to achieve reduction in size and cost.

Bearing the above object in mind, an ignition apparatus for an internal combustion engine according to the present invention includes: a transformer having a primary winding and a secondary winding with winding terminals at end portions thereof; an igniter that has connector side terminals and transformer side terminals electrically connected through the winding terminals for controlling an excitation current supplied to the primary winding; a connector that has input terminals electrically connected through the connector side terminals of the igniter for sending a drive signal for driving the igniter; and a case that receives the transformer and the igniter. The connector side terminals of the igniter is led out to the input terminal side of the connector, and the transformer side terminals of the igniter are led out to the winding terminal side of the transformer.

According to the ignition apparatus for an internal combustion engine of the present invention, connecting leads for electrically connecting between the igniter and the connector can be eliminated or shortened.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
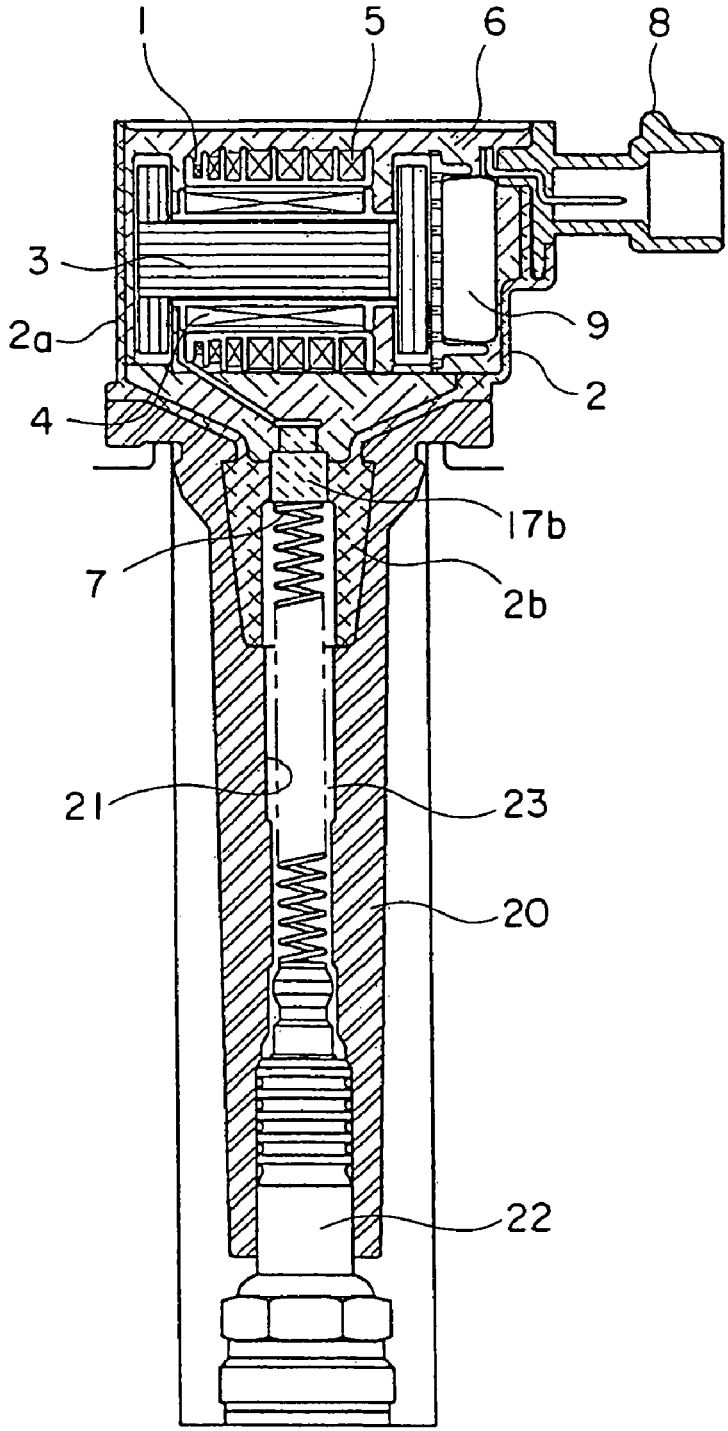
FIG. 1 is a cross sectional front elevational view showing an ignition apparatus for an internal combustion engine according to a first embodiment of the present invention.

Now, preferred embodiments of the present invention will be described in detail while referring to the accompanying drawings. Throughout respective figures, the same or corresponding members or parts are identified by the same reference numerals and characters.

Embodiment 1

Figure 2:
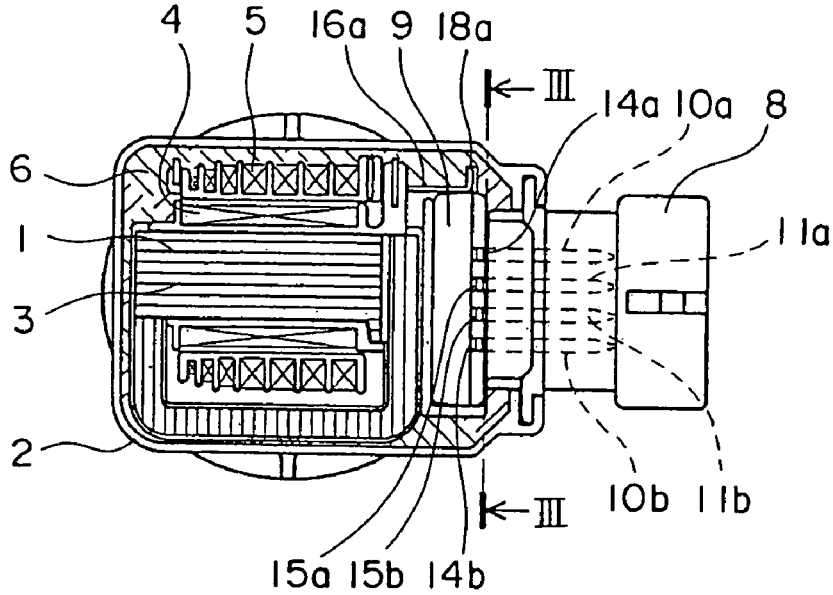
FIG. 2 is a cross sectional plan view showing the ignition apparatus for an internal combustion engine shown in FIG. 1.
Figure 3:
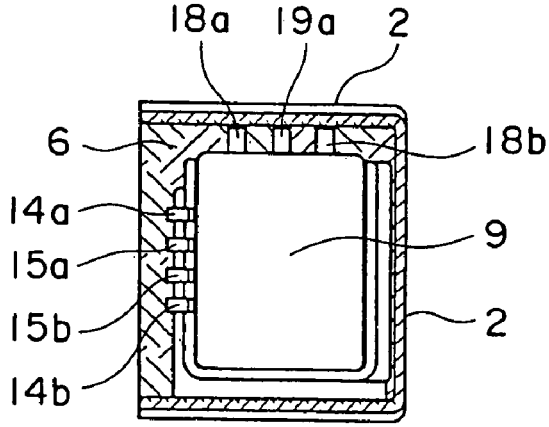
FIG. 3 is a cross sectional arrow view along line III-III in FIG. 2.
Figure 4:
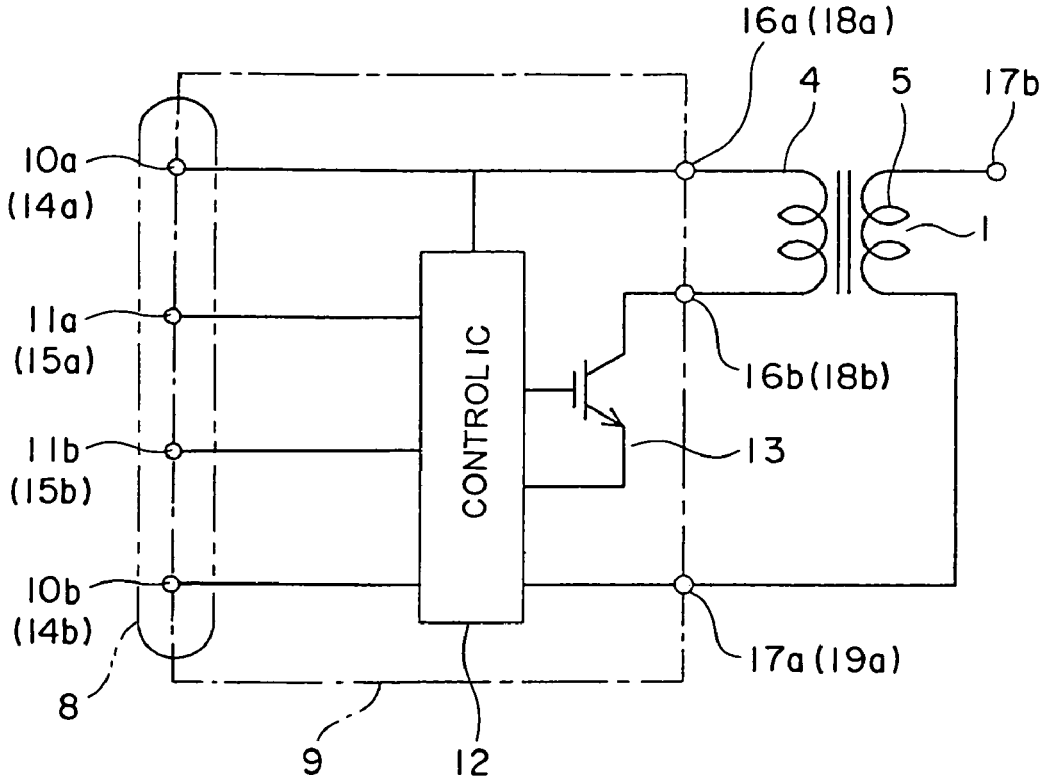
FIG. 4 is an electric circuit diagram of the ignition apparatus for an internal combustion engine shown in FIG. 1.

Referring to the drawings and first to FIG. 1, therein is shown an ignition apparatus for an internal combustion engine according to a first embodiment of the present invention. FIG. 2 is a cross sectional plan view showing the ignition apparatus for an internal combustion engine in FIG. 1, and FIG. 3 is a cross sectional arrow view along line III-III in FIG. 2. FIG. 4 is an electric circuit diagram of the ignition apparatus for an internal combustion engine shown in FIG. 1.

The ignition apparatus for an internal combustion engine has a transformer 1 received in a case 2. The transformer 1 has an iron core 3 that is formed of a plurality of thin steel plates laminated one over another, and a primary winding 4 and a secondary winding 5 that are wound around the iron core 3. The case 2 is composed of a case main body 2*a* that receives the transformer 1 electrically insulated and fixedly attached thereto by a cast insulating resin 6, and a high voltage tower 2*b* that is formed integrally with the case main body 2*a* and has an opening portion 7 placed in communication with the case main body 2*a*.

A connector 8 is mounted on a side surface of the case main body 2*a*.

In the interior of the case main body 2*a*, there is arranged an igniter 9 which is electrically connected to the transformer 1 and the connector 8, respectively, for controlling an excitation current supplied to the primary winding 4.

The connector 8 has a positive battery terminal 10*a*, a negative battery terminal 10*b*, a positive signal terminal 11*a*, and a negative signal terminal 11*b*, all of which serve as input terminals, and are integrated with one another by an insulating resin.

The igniter 9 includes; a control IC 12; a power transistor 13 that is driven by a drive signal from the control IC 12; and a positive battery side terminal 14*a*, a negative battery side terminal 14*b*, a positive signal side terminal 15*a* and a negative signal side terminal 15*b* which are directly connected to the positive battery terminal 10*a*, the negative battery terminal 10*b*, the positive signal terminal 11*a* and the negative signal terminal 11*b* of the connector 8, respectively.

Also, the igniter 9 is provided with a positive primary winding side terminal 18*a*, a negative primary winding side terminal 18*b* and a low-voltage side secondary winding side terminal 19*a* which are directly connected to a positive primary winding terminal 16*a*, a negative primary winding terminal 16*b* and the low-voltage side secondary winding terminal 17*a* of the primary winding 4, respectively.

The control IC 12, the power transistor 13, the battery side terminals 14*a*, 14*b*, the signal side terminals 15*a*, 15*b*, the primary winding side terminals 18*a*, 18*b*, and the low-voltage side secondary winding side terminal 19*a* are integrated with one another by the cast insulating resin 6. Here, note that a sign in parentheses ( ) indicates a terminal of the igniter 9 side in FIG. 4.

Figure 5:
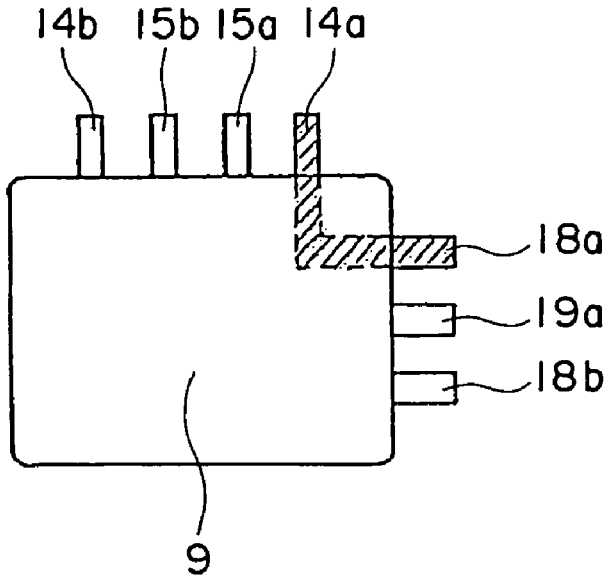
FIG. 5 is a front elevational view of an igniter shown in FIG. 1.
Figure 6:
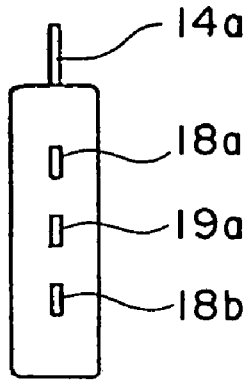
FIG. 6 is a side elevational view of the igniter shown in FIG. 5.

In addition, as shown in FIG. 5 and FIG. 6, the positive primary winding side terminal 18*a* and the negative primary winding side terminal 18*b* are arranged at the opposite sides of the low-voltage side secondary winding side terminal 19*a*, respectively.

The positive battery side terminal 14*a* is arranged adjacent to the positive primary winding side terminal 18*a*.

The opening portion 7 of the high voltage tower 2*b* is blocked with a high-voltage side secondary winding terminal 17*b*.

A plug boot 20 made of rubber is fitted onto the high voltage tower 2*b* of the case 2. The plug boot 20 is formed with a through hole 21 along the central axis thereof. A spring 23, being a conductor electrically connected to a spark plug 22, is arranged in the interior of the high voltage tower 2*b* arid in the through hole 21 so as to urge the spark plug 22 in a direction away from the high voltage tower 2*b* and the plug boot 20.

Now, reference will be made to an assembly procedure for the ignition apparatus for an internal combustion engine as constructed above.

First of all, the primary winding terminals 16*a*, 16*b* and the low-voltage side secondary winding terminal 17*a* of the transformer 1 are connected to the primary winding side terminals 18*a*, 18*b* and the low-voltage side secondary winding side terminal 19*a* of the igniter 9, respectively, by soldering for instance, whereby the transformer 1 and the igniter 9 are electrically connected to each other.

Then, the high-voltage side secondary winding terminal 17*b* is press-fitted into the opening portion 7 of the high voltage tower 2*b*, whereby the transformer 1 and the igniter 9 are built into the case 2.

Thereafter, the connector 8 is assembled to the case 2, and then the battery terminals 10*a*, 10*b* and the signal terminals 11*a*, 11*b* of the connector 8 are connected to the battery side terminals 14*a*, 14*b* and the signal side terminals 15*a*, 15*b* of the igniter 9, respectively, by soldering for example, whereby the connector 8 and the igniter 9 are electrically connected to each other.

Subsequently, the molten cast insulating resin 6 is injected into the case 2 and set therein, so that the transformer 1, the igniter 9 and the connector 8 are insulated from one another, and fixedly secured to one another.

Finally, the plug boot 20 with the spring 23 inserted into the through hole 21 is press-fitted into the high voltage tower 2*b*, thereby completing the assembly of the ignition apparatus for an internal combustion engine.

Here, note that the electrical connection of the connector 8 and the igniter 9 may be carried out at the same time when the transformer 1 and the igniter 9 are electrically connected to each other.

In this ignition apparatus for an internal combustion engine, an electric signal processed by an engine control unit (not shown) is sent to the control IC 12 of the igniter 9 through the connector 8. The control IC 12 generates a drive signal for the power transistor 13, and based on this signal, the-power transistor 13 controls an excitation current supplied to the primary winding 4, so that a high voltage is impressed to the high-voltage side secondary winding terminal 17*b*, whereby a discharge is made in a gap portion of the spark plug 22.

According to the ignition apparatus for an internal combustion engine as constructed above, the positive battery side terminal 14*a*, the negative battery side terminal 14*b*, the positive signal side terminal 15*a* and the negative signal side terminal 15*b*, all of which are the connector side terminals of the igniter 9, are directly connected to the positive battery terminal 10*a*, the negative battery terminal 10*b*, the positive signal terminal 11*a* and the negative signal terminal 11*b*, respectively, all of which are the input terminals of the connector 8. Also, the positive primary winding side terminal 18*a*, the negative primary winding side terminal 18*b* and the low-voltage side secondary winding side terminal 19*a*, all of which are the transformer side terminals of the igniter 9, are directly connected to the positive primary winding terminal 16*a*, the negative primary winding terminal 16*b* and the low-voltage side secondary winding terminal 17*a*, respectively, all of which are the winding terminals of the transformer 1. Accordingly, there is no need to specially use connecting leads for individual electrical connections of the igniter 9, the connector 8, and the transformer 1.

Figure 7:
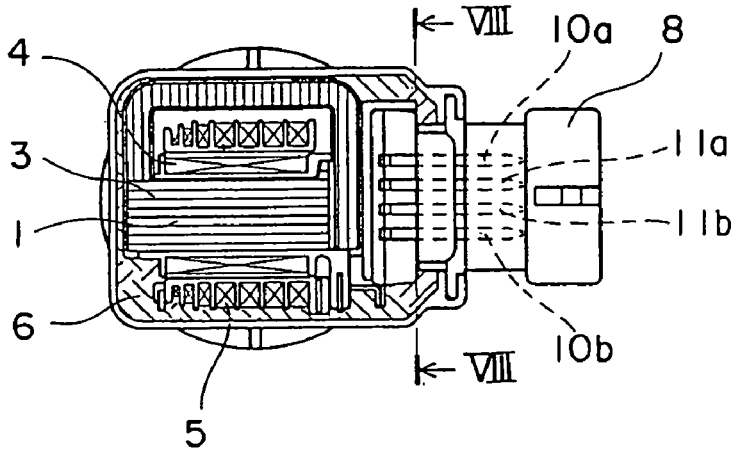
FIG. 7 is a cross sectional plan view showing another mode of use of the ignition apparatus for an internal combustion engine shown in FIG. 1.
Figure 8:
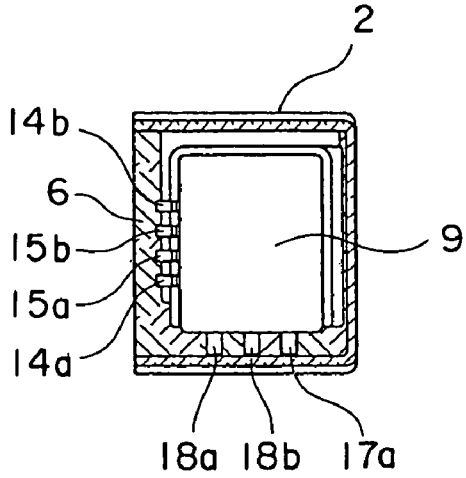
FIG. 8 is a cross sectional arrow view along line VIII-VIII in FIG. 1.

In addition, the positive primary winding side terminal 18*a* and the negative primary winding side terminal 18*b* are arranged at the opposite sides of the low-voltage side secondary winding side terminal 19*a*, respectively. As a result, as shown in FIG. 7 and FIG. 8, only by reversing the igniter 9, the present invention can also be applied to an ignition apparatus for an internal combustion engine with a reversed arrangement of the input terminals at the connector 8 side, by using the same igniter 9.

Further, the positive battery side terminal 14*a* is arranged adjacent to the positive primary winding side terminal 18*a*, so the wiring inside the igniter 9 can be shortened and simplified, as indicated by hatch lines in FIG. 5.

Here, note that the individual terminals 14*a*, 14*b*, 15*a*, 15*b*, which are the connector side terminals of the igniter 9, and the individual terminals 18*a*, 18*b*, 19*a*, which are the transformer side terminals of the igniter 9, are led out in individually different directions, but they can be led out in the same direction depending upon the arrangement of the individual terminals 10*a*, 10*b*, 11*a*, 11*b*, which are the input terminals of the connector 8, and the arrangement of the individual terminals 16*a*, 16*b*, 17*a*, which are the winding terminals of the transformer 1.

Embodiment 2

Figure 9:
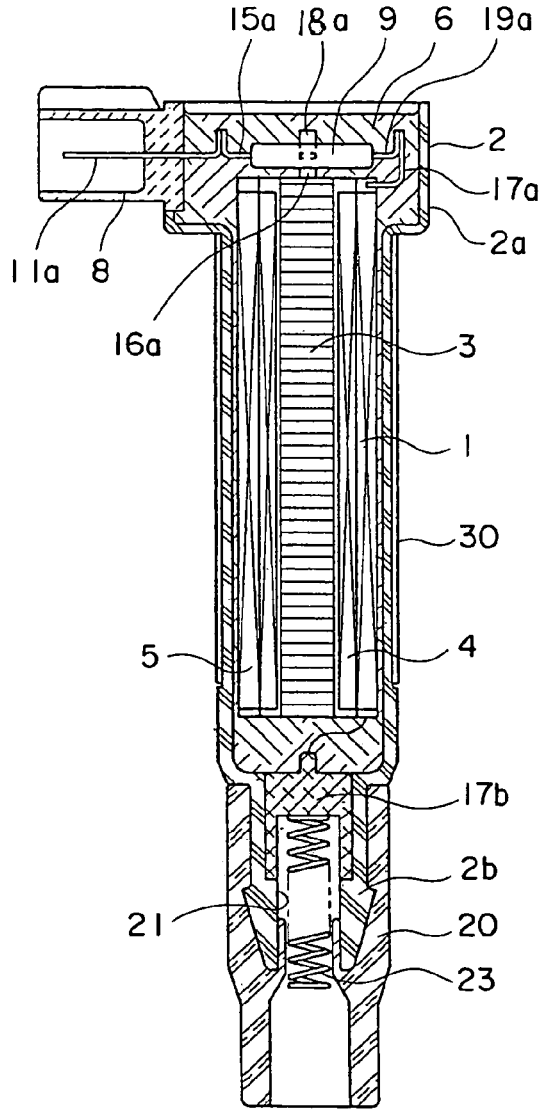
FIG. 9 is a cross sectional front elevational view showing an ignition apparatus for an internal combustion engine according to a second embodiment of the present invention.
Figure 10:
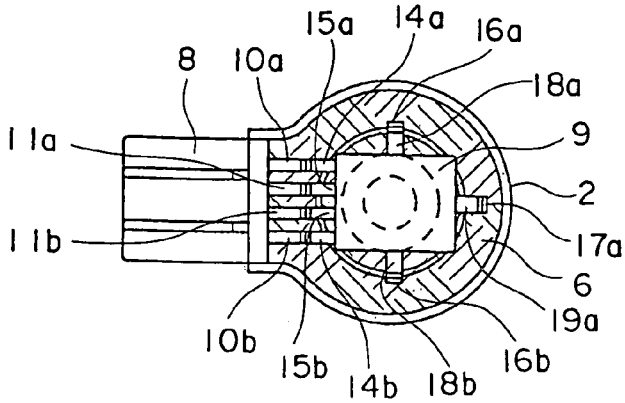
FIG. 10 is a cross sectional plan view showing the ignition apparatus for an internal combustion engine shown in FIG. 9.

FIG. 9 is a cross sectional front elevational view that shows an ignition apparatus for an internal combustion engine according to a second embodiment of the present invention. FIG. 10 is a cross sectional plan view that shows the ignition apparatus for an internal combustion engine shown in FIG. 9.

In this embodiment, a transformer 1 extends toward a high voltage tower 2*b* in the interior of a case main body 2*a*. The transformer 1 is composed of an iron core 3 formed of laminated thin sheet plates, a primary winding 4 surrounding the iron core 1, and a secondary winding 5 surrounding the primary winding 4. On the outer peripheral surface of the case main body 2*a*, there is arranged an exterior iron core 30 which becomes a path through which passes a magnetic flux generated when a primary current is supplied to the primary winding 4.

An igniter 9 arranged in the case main body 2*a* has a positive primary winding side terminal 18*a*, a low-voltage side secondary winding side terminal 19*a* and a negative primary winding side terminal 18*b* led out in three directions, respectively. A positive primary winding terminal 16*a*, a low-voltage side secondary winding terminal 17*a* and a negative primary winding terminal 16*b* of the transformer 1 are arranged at locations to which the individual terminals 18*a*, 19*a*, 18*b* are to be led out, so that they are electrically connected to the terminals 18*a*, 19*a*, 18*b* directly through soldering or welding, respectively.

In addition, the positive battery side terminal 14*a*, the negative battery side terminal 14*b*, the positive signal side terminal 15*a* and the negative signal side terminal 15*b* of the igniter 9 are led out to the connector 8 side. The individual terminals 14*a*, 14*b*, 15*a*, 15*b* are electrically directly connected to the positive battery terminal 10*a*, the negative battery terminal 10*b*, the positive signal terminal 11*a* and the negative signal terminal 11*b* of the connector 8, respectively, through soldering or welding.

The construction of this second embodiment other than the above is similar to that of the first embodiment.

According to the ignition apparatus for an internal combustion engine of this second embodiment, similar to the first embodiment, the individual terminals 14*a*, 14*b*, 15*a*, 15*b* in the form of the connector side terminals of the igniter 9 are directly connected to the individual terminals 10*a*, 10*b*, 11*a*, 11*b* in the form of the input terminals of the connector 8, and the individual terminals 18*a*, 18*b*, 19*a* in the form of the transformer side terminals of the igniter 9 are directly connected to the individual terminals 16*a*, 16*b*, 17*a*, respectively, which are the winding terminals of the transformer 1. Accordingly, there is no need to specially use connecting leads for individual electrical connections of the igniter 9, the connector 8 and the transformer 1.

In both of the above-mentioned respective embodiments, reference has been made to an ignition apparatus for an internal combustion engine in which the connector side terminals 14*a*, 14*b*, 15*a*, 15*b* of the igniter 9 are directly connected to the input terminals 10*a*, 10*b*, 11*a*, 11*b* of the connector 8, and the transformer side terminals 18*a*, 18*b*, 19*a* of the igniter 9 are directly connected to the winding terminals 16*a*, 16*b*, 17*a* of the transformer 1, respectively, but the present invention can be applied even to an ignition apparatus for an internal combustion engine in which the connector side terminals of the igniter and the input terminals of the connector are connected to one another through connecting leads, and the transformer side terminals of the igniter and the winding terminals of the transformer are connected to one another through connecting leads. In this case, there is an advantageous effect that the lengths of the connecting leads can be shortened in comparison with the conventional ones.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising:

a transformer having a primary winding and a secondary winding with winding terminals at end portions thereof;

an igniter that has connector side terminals and transformer side terminals electrically connected through said winding terminals for controlling an excitation current supplied to said primary winding;

a connector that has input terminals electrically connected through said connector side terminals of said igniter for sending a drive signal for driving said igniter; and a case that receives said transformer and said igniter;

wherein said connector side terminals of said igniter is led out to said input terminal side of said connector, and said transformer side terminals of said igniter are led out to said winding terminal side of said transformer.

2. The ignition apparatus for an internal combustion engine as set forth in claim 1, wherein said connector side terminals and said transformer side terminals are led out in different directions, respectively.

3. The ignition apparatus for an internal combustion engine as set forth in claim 1, wherein said winding terminals comprise a positive primary winding terminal and a negative primary winding terminal that are arranged at opposite ends of said primary winding, and a low-voltage side secondary winding terminal that is arranged at a low-voltage side end of said secondary winding;

said transformer side terminals comprise a positive primary winding side terminal, a negative primary winding side terminal and a low-voltage side secondary winding side terminal which are connected to said positive primary winding terminal, said negative primary winding terminal and said low-voltage side secondary winding terminal, respectively;

said positive primary winding side terminal and said negative primary winding side terminal are arranged at opposite sides of said low-voltage side secondary winding side terminal, respectively.

4. The ignition apparatus for an internal combustion engine as set forth in claim 1, wherein a positive battery side terminal, which is electrically connected to a positive battery terminal, of said connector side terminals is arranged adjacent to said positive primary winding side terminal, which is connected to said positive primary winding terminal arranged at an end of said primary winding, of said transformer side terminals.

5. The ignition apparatus for an internal combustion engine as set forth in claim 1, wherein said connector side terminals of said igniter are directly connected to said input terminal side of said connector, and said transformer side terminals of said igniter are directly connected to said winding terminal side of said transformer.

* * * * *